United States Patent [19]

Seidman et al.

[11] 3,976,905

[45] Aug. 24, 1976

[54] CHANNEL ELECTRON MULTIPLIERS

[75] Inventors: Ady Seidman, Tel Aviv; Zohar Avrahami, Ramat Gan; Benjamin Sheinfux, Tel Aviv; Jan Grinberg, Holon, all of Israel

[73] Assignee: Ramot University for Applied Research and Industrial Development Ltd., Tel-Aviv, Israel

[22] Filed: June 17, 1974

[21] Appl. No.: 480,683

[30] Foreign Application Priority Data

July 5, 1973 Israel ..... 42668

[52] U.S. Cl. ..... 313/103 CM; 313/105 CM; 328/243

[51] Int. Cl.[2] ..... H01J 43/06; H01J 43/10

[58] Field of Search ..... 313/105 CM, 103, 104

[56] References Cited

UNITED STATES PATENTS

| | | | |
|---|---|---|---|
| 3,184,633 | 5/1965 | White et al. | 313/104 X |
| 3,321,660 | 5/1967 | Ramberg | 313/103 |
| 3,458,745 | 7/1969 | Shoulders | 313/105 CM X |
| 3,626,233 | 12/1971 | Wainer | 313/105 CM |
| 3,808,494 | 4/1974 | Hayashi et al. | 313/103 |

*Primary Examiner*—Robert Segal
*Attorney, Agent, or Firm*—Benjamin J. Barish

[57] ABSTRACT

A channel electron multiplier is described having a tubular wall coated with a secondary-electron emitting material and including an electric field for accelerating the electrons, the electric field comprising a plurality of low-resistive conductive rings each alternating with a high-resistive insulating ring. The thickness of the low-resistive rings is many times larger than that of the high-resistive rings, being in the order of tens of microns for the low-resistive rings and at least one order of magnitude lower for the high-resistive rings; and the diameter of the channel tubular walls is also many times larger than the thickness of the high-resistive rings. Both single-channel and multiple-channel electron multipliers are described. A very important advantage, particularly in making multiple-channel multipliers, is the simplicity of the procedure that may be used in constructing such multipliers. Other operational advantages are described.

11 Claims, 3 Drawing Figures

CHANNEL ELECTRON MULTIPLIERS

BACKGROUND OF THE INVENTION

The present invention relates to channel electron multipliers, both single-channel and multiple-channel types, such as are used for detecting low energy electrons and other charged particles or radiations and producing amplified outputs thereof.

Channel electron multipliers are commonly used to detect any charged particles or radiation capable of producing secondary electrons. Some applications to which they have been put are for detecting electrons, ions, alpha-particles, beta-particles, X-rays and ultraviolet photons; and some of the fields in which they have been used are X-ray and ultraviolet astronomy, filed ion microscopy, mass spectrometry, and ultra-violet spectroscopy.

The conventional single channel electron multiplier consists of a glass tube under vacuum, the inner surface of which tube is coated with a semi-insulating or resistive material capable of emitting secondary electrons when struck by an incident electron or other charged particle or radiation. The resistivity of the coating is about $10^8$ to $10^{13}$ ohms between the electrodes so that a strong electric field can be generated. The ratio of channel length to diameter for optimal multiplication is about 50:1. A voltage is applied between the ends of the tube to produce a fairly uniform electric field within it. Electrons which enter the tube are accelerated by the electric field until they strike the resistive coating, causing secondary electrons to be emitted, which in turn are accelerated and strike the resistive coating to cause further secondary electrons to be emitted. The gain of such multipliers varies between $10^3$ and $10^8$.

The gain of the multiplier is independent of its absolute dimensions, and therefore these dimensions may be made extremely small. A large number of such channel multipliers may therefore be mounted in parallel and used to detect radiation in two dimensions. One form of such array of multiple-channel multipliers, called a channel plate, is made by fusing a plurality of straight channels together to form a honeycomb-like cross-section, polishing the input and output faces of the plate, and evaporating a thin metallic coating on these polished faces at an oblique angle, such that the coating connects the glass interstices at the end of the channels but leaves the channel tubes open. A typical channel plate, composed of 40 micron diameter channels, may have an open area of 60% and a thickness of 2mm.

Most of the research efforts in this field have been concentrated on the development of the single channel multiplier, mainly to improve its functioning and to make the channel diameter as small as possible. Extended experimental and theoretical studies have been made on different secondaryemission materials and on the influence of the various parameters governing the properties of the channels. Outstanding high gain, narrow pulse height distribution, and substantial channel uniformity having a diameter of a few microns have been attained.

Very low noise and low dark current devices, such as channeltrons and spiraltrons, have been fabricated and used.

On the other hand, less attention has been paid to the construction of channel plates, although they have found applications in space-exploration experiments and in field-ion microscopy. Channel plates have been built in the manner described earlier with a position resolution as high as 50 lines per mm. However, the effective area of these devices is very small (a few tenths of an in. sq.), and therefore in the electro-optical systems in which they have been used (e.g. the vidicon), the image has to be first reduced considerably in size, resulting in a low gain and a low uniformity.

Another serious drawback of the prior devices is their high cost, since their fabrication, particularly the multiplechannel multiplier, involves a complicated and costly procedure.

SUMMARY OF THE PRESENT INVENTION

The present invention aims to provide novel channel electron multipliers, both single-channel and multiple-channel types, having advantages over the known devices, and particularly having the advantage of enabling them to be constructed at substantially lower cost than the known types. Other advantages will be set forth below.

The channel electron multiplier of the present invention includes a tubular wall, a coating on the inner surface of the tubular wall of a resistive material capable of emitting secondary electrons when struck by an incident electron or other charged particle or radiation, and means for producing an electric field within the channel for accelerating the electron or other charged particle and causing it to strike the resistive coating to produce electrons by secondary emission. According to one aspect of the present invention, the electric field producing means comprises a plurality of low-resistive rings each alternating with a high-resistive ring, the rings being carried by and extending axially along the tubular wall under the secondary emission resistive coating, and means for applying a stepped electric voltage gradient to the plurality of low-resistive rings. The low resistive rings are each of a thickness many times larger than that of the high-resistive rings, and the diameter of the channel tubular wall is also many times larger than the thickness of the high-resistive rings. Such an arrangement provides an electric field of near staircase distribution within the channels.

According to a further aspect, the electron multiplier is constituted of a plurality of layers of low-resistive material each alternating with a layer of high-resistive material, the tubular wall of the channel being defined by an opening extending through the plurality of layers, the secondaryemission resistive coating on the tubular wall being in contact with the edges of the low-resistive and high-resistive layers defining said opening.

Particularly good results have been produced when the thickness of the low-resistive layers is in the order of tens of microns, the thickness of the high-resistive layers is at least one order of magnitude lower, and the diameter of the channel tubular wall is at least as large as the thickness of the lowresistive layers.

In one described embodiment, the plurality of layers are constituted of low-resistive layers whose surfaces have been chemically altered to form the high-resistive layers.

In another described embodiment the plurality of layers are constituted of low-resistive coatings alternating with high-resistive coatings.

According to a still further feature, the means for applying the stepped voltage gradient comprises a voltage-dividing resistive material across which the electric voltage is applied, the voltage driving resistive material contacting successively the plurality of low-resistive layers to divide the applied voltage between them.

The construction as briefly described above may be used for making both single-channel and multiple-channel electron multipliers in a relatively simple and inexpensive manner. In addition, such a construction would appear to have a number of operational advantages, described more fully below.

BRIEF DESCRIPTION OF THE DRAWINGS

The invention is herein described, somewhat diagrammatically and by way of example only, with respect to the accompanying drawings, wherein.

DESCRIPTION OF THE PREFERRED EMBODIMENT

Figure 1:
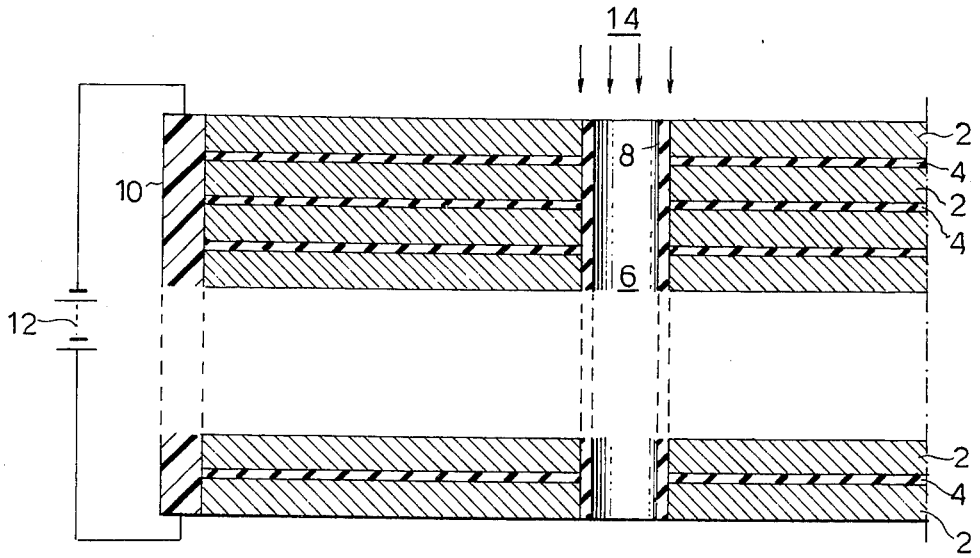
FIG. 1 is an enlarged sectional view of a single-channel electron multiplier constructed in accordance with the invention.

The single-channel electron multiplier illustrated in FIG. 1 comprises a plurality of layers 2 of low-resistive or conductive material, each layer alternating with a layer 4 of high-resistive or insulating material. Each layer 2 is substantially thicker, by many times, than the high-resistive layers 4. For example, the low-resistive layers 2 may each have a thickness in the order of tens of microns, whereas the thickness of the high-resistive layers 4 substantially less by at least one order of magnitude, i.e., in the order of microus or tenths of microns.

A hole 6 is formed through layers 2 and 4, the diameter of the hole being no less than the thickness of the lowresistive layers 2. The inner surface of the hole is coated with a resistive material 8 capable of emitting secondary electrons when struck by an incident electron. Many such materials are known, examples being aluminium oxide and magnesium oxide.

A stepped voltage gradient is applied to the low-resistive layers 2 by means of a voltage-divider layer or member 10 of another resistive material. An external voltage 12 is applied across layer 10, the member contacting successively the series of low-resistive layers 2 to thereby divide the applied voltage between them.

The foregoing geometrical relations are intended to generate a non-uniform electric field within the channel. The field can be distinguished by two alternating forms along the channel: (a) a weak axial field component in the section of the low-resistive (conducting) rings in order to cause axial electron drift and (b) a strong axial and radial component at the interface of two consecutive low-resistive rings in order to provide the electron with sufficient energy to produce secondary emission and to accelerate the electron towards the tubular wall.

Figure 2:
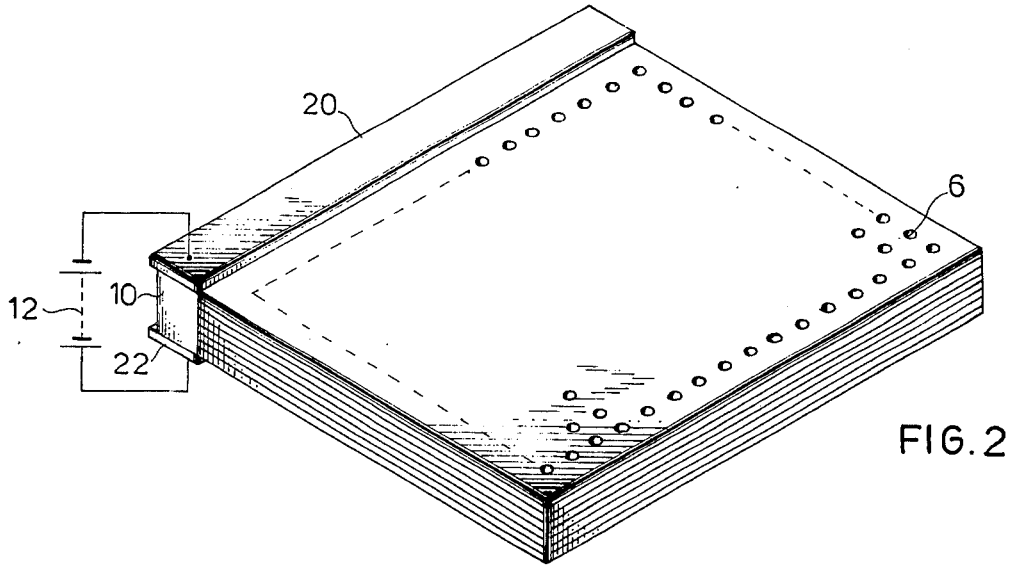
FIG. 2 is a perspective view of a multiple-channel electron multiplier, of the type called a channel plate, constructed in accordance with the invention.

FIG. 2 illustrates a similar arrangement for making a multiple-channel electron multiplier, wherein a plurality of holes 6 are formed through layers 2, 4. These holes may be very closely spaced, and in FIG. 2 they are shown in a rectangular matrix array. The voltage-dividing member is in the form of a resistive layer 10 applied at one side of the device in contact with the layers 2, 4 to provide the stepped voltage gradient to the low-resistive layers 2. The external voltage 12 is applied between upper and lower electrodes 20, 22 engaging the opposite faces of the voltage divider layer 10 so that the complete plane of each layer 2 receives the same voltage.

Many techniques are known and may be used for making the devices of FIGS. 1 and 2. As one example, the various layers could be of known low-resistive and high-resistive materials built up by conventional deposition processes, e.g. vapour deposition, using suitable masks or a substrate formed with pins to produce the holes 6. The voltage-dividing layer 12 could be of the appropriate resistive material (e.g. graphite, cermet) applied as a continuous layer to the edges of layers 2, 4 to produce the stepped voltage gradient to the low-resistive layers 2.

Another method of making the multipliers illustrated in FIGS. 1 or 2 would be to use a plurality of metal strips, for example aluminium, of the appropriate thickness, and to chemically alter their surfaces to form a thin insulating film, e.g. aluminium oxide. The strips are then assembled one on top of the other to form a unitary assembly, e.g. by heat and pressure, whereupon the metal strips form the low-resistive layers 2 and the insulating films form the thin high-resistive layers 4. The hole or holes 6 are then formed through the layers.

Many techniques are known for making very fine and closely spaced holes, for example chemical etching, electroerosion, or burning by the use of lasers. The inner surface of the holes may then be formed with the resistive film 8. Since aluminium oxide is such a resistive, secondary-electronemitting material, this film may also be formed by oxidizing the aluminium of the original metal strips. The voltagedivider layer 12 may then be applied, for example by evaporation of a resistive material on the ends of the aluminium strips.

Before use, the multiplier devices illustrated in FIGS. 1 and 2 would be enclosed within a vacuum envelope (not shown).

Each hole 6 through the layers 2, 4, forms a tubular multiplier channel, the wall is defined by the edges of the layers. The edges of the alternating low-resistive and highresistive layers thus form a series of conductive rings alternating with insulating rings extending axially along the tubular wall of the multiplier channel, these rings being covered by and in contact with the secondary-emission resistive coating 8. The voltage-divider 10, being in contact with all the layers, distributes the externally-applied voltage 12 as a stepped voltage gradient to the low-resistive rings formed by layers 2. Since each low-resistive ring is insulated from the next by an extremely-thin insulating ring (high-resistive layers 4), a strong electrical field is produced across the insulating rings, whereas a weak field is produced axially of the channel.

An electron entering the channel from the input side 14 of the multiplier is accelerated by the foregoing strong field towards the inner surface of the channel, where it strikes resistive coating 8, causing the coating to emit secondary electrons. These electrons drift toward the next layer. When they pass between two low-resistive layers 2, they are strongly accelerated toward the channel surface and gain energy, equal to the potential difference between the adjacent layers multiplied by the electron charge. These electrons then strike the resistive film 8, causing the emission of further electrons. Cascadic multiplication is thus achieved producing a large number of electrons at the output end of the channel.

The number of layers and the overall voltage 12 applied across the voltage divider layer 10 determine the gain of the multiplier. The overall voltage 12 must be less than the breakdown voltage of each insulating layer 4 multiplied by the number of insulating layers. Voltage 12 would normally be in the order of several (e.g. 2) kilovolts.

It will be appreciated that the above-mentioned channel electron multiplier has a very important advantage over the known devices in that it can be constructed by using a relatively simple and inexpensive process. However, it would also appear that this construction has a number of operational advantages, including smaller standard deviation of multiplication factor, a larger dynamic range, and a faster time response, when compared to the conventional channel multipliers. The foregoing advantages, or some of them as well as possibly others, are believed to be achieved by the novel structures of the present invention, in view of the following observations.

The standard deviation is caused mainly by the:

1. randomness of electron path;
2. standard deviation of secondary emission effect; and
3. randomness of emission energy of the secondary electrons.

The electron path in the conventional channel is determined by the radial component of its velocity, which is given to large statistical fluctuations. The multiplication factor fluctuates accordingly. In the present invention the electron path is governed by the strong electric fields between the layers. These electric fields may be designed to force the electrons to collide with almost each layer, and therefore the multiplication factor would appear to have a smaller standard deviation.

The location of the first impact of the entering electron in the conventional channel is determined by its random velocity and contributes to the spread of the multiplication factor. In the present invention, this spread is reduced by the fact that already at the entrance of the channel the strong electric field is applied. The probability of a collision with the very thin first conductive layer 2 is negligible, and therefore the electron is forced to collide with the second conductive layer 2 thus defining the location of the first impact.

The standard deviation of the secondary emission process depends on the energy and direction of the primary electron.

In the present invention these parameters are controlled by the applied voltage in order to reduce this deviation, whereas in the conventional channel multiplier devices they are random.

The energy of the impinging electron is related to the sum of its initial energy and the energy gained due to the electric field. In the present invention the energy gained due to the field is determined by the potential difference between the layers and may be designed to be dominant. In the conventional channel multiplier the energy gained due to the electric field depends on the radial component of the velocity of the electron.

The multiplication factor is, at first approximation, a function of the number of collisions. In the present invention this factor is governed by the number of layers and the applied voltage, rather than by the length-to-diameter ratio. This is an advantage for many applications.

In the conventional channel, the dynamic range is limited by the current through the resistive layer (8), by the relaxation time, and by the space charge which determine the saturation of the device. In the present invention, due to the external voltage divider (10), higher power dissipation is facilitated and therefore the saturation of the device occurs only at higher outputs.

The relaxation time is limited by the diffusion of electrons into the secondary emission layer (8). The diffusion rate depends on the current through the divider, which can be made greater in the present case.

The limitation due to the space charge becomes significant towards the end of the channel. By employing layers of various thickness and by creating a non-homogenous electric field along the channel, it is possible to control the space charge formed in the channel in order to reduce its effect.

The delay of the channel depends on its length and the electron's path. In the case of the present invention, since the path is determined more by the special form of the electric field, the delay is shorter and more stable. (i.e. time jitter is decreased).

Figure 3:
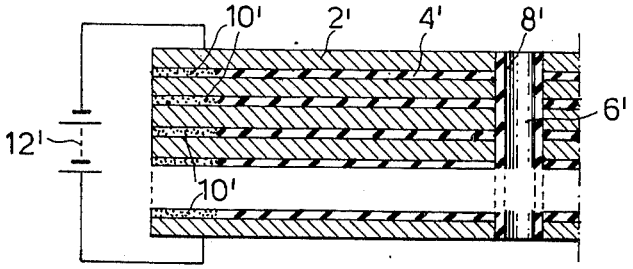
FIG. 3 is a partial sectional view of another form of single-channel electron multiplier constructed in accordance with the invention.

A further advantage, particularly with respect to the multiple-channel multiplier, is that the electric field along all the channels is substantially identical (as voltagedivider layer 10 supplies the voltage in parallel to the layers of all the channels), and therefore the electrical performance is substantially uniform across the whole channel plate. FIG. 3 illustrates a further modification, wherein the voltage-dividing resistive material, instead of being applied as a continuous layer to the edges of the low-resistive and high-resistive layers, is rather applied in the form of high-resistance deposits 10' between each pair of low-resistive layers 2' to produce a high-resistance conductive pathway from the voltage source 12' through the low-resistive layers 2'. The other elements, namely high-resistive layers 4', holes 6', and secondary-emission resistive layer 8', may be the same as in FIGS. 1 and 2.

Many other variations, modification and applications will be apparent.

What is claimed is:

1. A channel electron multiplier including a plurality of layers of low-resistive material each alternating with a layer of high-resistive material; a tubular wall defined by an opening extending through the plurality of layers so as to form a plurality of axially-extending rings constituted by the edges of the opening through the layers, and a secondaryemission coating thereover; the low-resistive layers being each of a thickness many times large than that of the high-resistive layers, the diameter of the tubular wall being many times larger than the thickness of the high-resistive layers; said secondary-emission coating being in contact with the edges of the low-resistive and high-resistive layers defining said opening, and bring of a resistive material capable of emitting secondary electrons when struck by an incident electron or other charged particle or radiation; and means for applying a stepped electric voltage gradient to said plurality of low-resistive rings to thereby produce an electric field within the tubular wall which electric field has a radial component for accelerating the electron or other charged particle and for causing it to strike the resistive coating and to produce electrons by secondary emission.

2. An electron multiplier according to claim 1, wherein the thickness of the lowresistive layers is in the order of tens of microns, the thickness of the high-resistive layers is substantially less by at least one order of magnitude, and the diameter of the channel tubular wall is at least as large as the thickness of the low-resistive layers.

3. An electron multiplier according to claim 1, wherein said plurality of layers are constituted of low-resistive layers whose surfaces have been chemically altered to form the high-resistive layers.

4. An electron multiplier according to claim 1, wherein said plurality of layers are constituted of low-resistive coatings alternating with high-resistive coatings.

5. An electron multiplier according to claim 1, wherein the secondary emission resistive material is constituted of chemically altered portions of the low-resistive layers at the edges thereof defining said opening through the plurality of layers.

6. An electron multiplier according to claim 1, wherein said means for applying the stepped voltage gradient comprises a voltage-dividing resistive material across which the electric voltage is applied, the voltage-dividing resistive material contacting successively the plurality of low-resistive layers to divide the applied voltage between them.

7. An electron multiplier according to claim 6, wherein the voltage-dividing resistive material is in the form of a continuous layer applied to an edge of the plurality of layers.

8. An electron multiplier according to claim 6, wherein the voltage-dividing resistive material is in the form of high-resistive deposits applied between adjacent low-resistive layers to produce a high-resistance conductive pathway from the voltage source through the low-resistive layers.

9. An electron multiplier according to claim 1, wherein said low-resistive layers are of aluminium, and said highresistive and electron emission layers are of oxidized aluminium.

10. A multiple channel electron multiplier including a block formed with a plurality of channels each according to claim 1.

11. A multiple channel electron multiplier according to claim 10, wherein the channels are arrayed according to a rectangular matrix.

* * * * *